United States Patent [19]

Dornes et al.

[11] Patent Number: 4,555,847

[45] Date of Patent: Dec. 3, 1985

[54] CONNECTOR INSERTION TOOL

[75] Inventors: Bryan J. Dornes, Hershey; Robert J. Talarico, Camp Hill, both of Pa.

[73] Assignee: AMP Incorporated, Harrisburg, Pa.

[21] Appl. No.: 618,982

[22] Filed: Jun. 11, 1984

[51] Int. Cl.[4] ..... H01R 43/00

[52] U.S. Cl. ..... 29/739; 29/758

[58] Field of Search ..... 29/739, 741, 747, 758, 29/845

[56] References Cited

U.S. PATENT DOCUMENTS 4,383,361 5/1983 Kautz ..... 29/739

*Primary Examiner*—Howard N. Goldberg
*Assistant Examiner*—Timothy V. Eley
*Attorney, Agent, or Firm*—F. Brice Faller

[57] ABSTRACT

Connector insertion tool for mounting to a press having a magnetic chuck and mass inserting a plurality of contact pins depending from a connector into a printed circuit board comprises a body having bores therethrough and two rows of insertion fingers extending therefrom. A coil spring inside telescoping tubes in each bore urges a guide slidably mounted on the fingers away from the body when mounted to the press, or alternately urges a tube out of the bore opposite the guide before mounting to the press.

3 Claims, 8 Drawing Figures

83
31
28
25
24
26
67
66
69
70
68
76
78
72
77
73
74
80
82
18
15
20
14
19
18
16
17
34
55
58
59
50
54
34
35
43
41
36
38
42
53
63
62
50
52
56
61
60
48
46
47

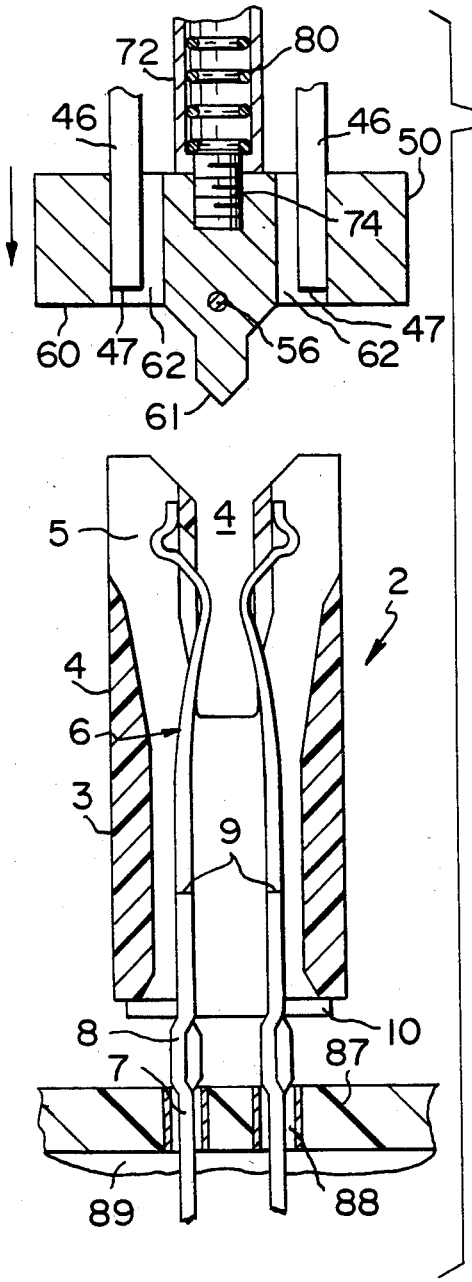
FIG. 6
FIG. 7
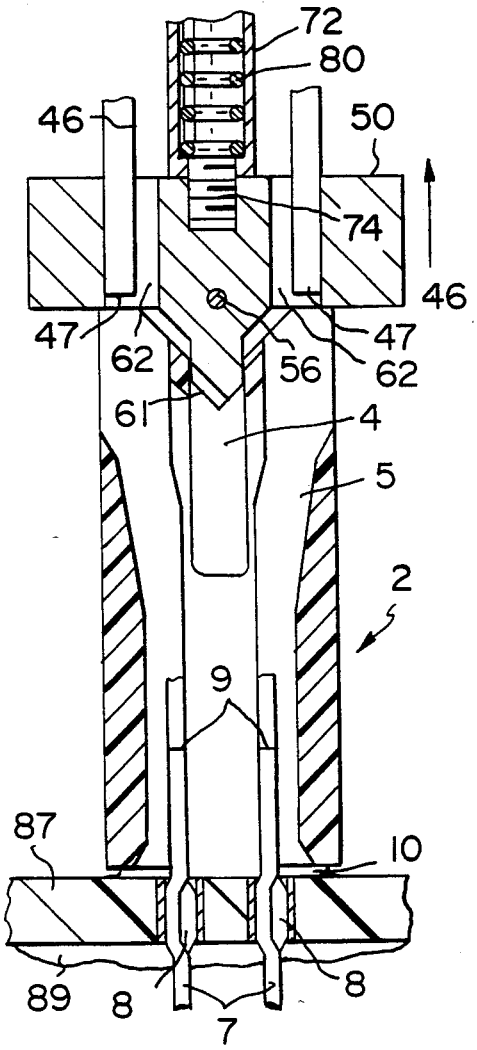

CONNECTOR INSERTION TOOL

BACKGROUND OF THE INVENTION

This invention relates to a tool for mounting to a press and mass inserting a plurality of contact pins depending from a connector into a printed circuit board, and particularly to a tool for use in concert with like tools on a hydraulic press having a magnetic chuck.

U.S. Pat. No. 4,383,361 discloses a connector insertion tool for mounting to a press and mass inserting a plurality of contact pins depending from a connector into a printed circuit board, the tool being of the type comprising a body having a top surface and an opposed bottom surface, two rows of insertion fingers extending from the bottom surface, and guide means slidably mounted on the fingers. Shaft means fixed to said guide means is slidably received in bore means in the body, and spring means is effective to urge the guide means away from the body when the body is mounted to the press. The guide means is received in the card-receiving slot of a card edge connector and serves to align it for reception of the insertion fingers during the downstroke of a press to which the tool is mounted. As the downstroke progresses, the insertion fingers move into apertures in the connector housing and the guide means moves toward the body. The shaft means, in the form of a solid rod, emerges from the top surface as the spring means, in the form of a coil concentric to the rod, is compressed. The bottom surface or chuck of the press must thus be profiled with an array of holes to receive the rods emerging from the top surface of the tool body. Since the tools are generally used in concert with like tools to apply a group of connectors to a printed circuit board, the array of holes in the chuck must match the printed circuit board. Thus the chuck would have to be changed for different PCB's.

One solution to the problem of the emerging shaft means is to design a tool with a body high enough to contain the shaft therein as the guide moves toward the bottom surface of the tool body. However, some means for fixing the tool to the chuck is still required. A magnetic chuck which holds the tool thereto by electromagnetism would thus permit a chuck surface to which any array of tools with steel top surfaces could be fixed.

U.S. application Ser. No. 618,983, a companion application filed concurrently with this application, and hereby incorporated by reference, describes a method suitable for mass mounting connectors to a PCB, using a hydraulic press having a magnetic chuck, as well as necessary apparatus. The method of force-fitting components into a PCB comprises the steps of: locating in alignment with a magnetic chuck on a press platen, a dummy workpiece having tool supports fixed thereto in a predetermined array with predetermined spacing therebetween and a component insertion tool removably surmounting each tool support; moving the platen towards the workpiece to secure each tool magnetically to the chuck; withdrawing the platen thereby to remove each tool from the support surmounted thereby; replacing the dummy workpiece by an actual workpiece with components arranged thereon in said predetermined array and with said predetermined spacing therebetween; and moving the platen with the tools thereon towards the dummy workpiece to cause each tool on the chuck to force-fit the corresponding component into the actual workpiece.

A new dummy workpiece can be prepared each time the arrangement of, or the nature of, the components on the workpiece is to be modified. The labor and expense of mounting fresh permanent tooling to the platen is thereby avoided.

The described method involves mounting the insertion tool to a tool support on a dummy workpiece, which in practice may be a card edge connector mounted to a printed circuit board. The magnetic chuck then picks up the tool. A problem arises with a tool of the type having a high body containing the rod therein insofar as the height of such a tool causes any angular displacement or leaning of the tool to increase the misalignment of the tool when it is withdrawn from the dummy workpiece. Any leaning is aggravated by the high center of gravity associated with such a tool.

SUMMARY OF THE INVENTION

According to the invention, a connector insertion tool of the first type described above is especially adapted for magnetic mounting of the top surface to a press. The shaft means comprises telescopic tube means slidably mounted in the bore means in the body and extendable from either opposed surface, the spring means comprising a coil spring mounted inside each telescoping tube means.

The tube means is collapsed to load the spring in compression when the body is mounted to the press and the guide means is moved toward the bottom surface during insertion of the contacts or moving the upper platen toward the dummy workpiece. The spring is effective to extend the tube means from the bottom surface to move the guide means away from the bottom surface during withdrawal of the tool after contact insertion, or during withdrawal from the dummy workpiece. The spring is effective to extend the tube means from the top surface of the body when the body is not mounted to the platen and the guide means is toward the bottom surface, as when the tool is mounted to a tool support on the dummy workpiece prior to descent of the press.

The telescoping tube design permits a low profile tool body which considerably reduces any tool misalignment on the chuck. It follows that the "shut height" of the tool, which is the distance between the chuck and the lower platen supporting the dummy workpiece or PCB, is correspondingly reduced. Prior art tools for connectors of the type described herein, an example of which is sold by AMP incorporated as its PACE connector, have been higher than tooling used for other types of connectors. Such tooling has been used with spacers to require a uniform shut height when connectors are mixed on a given PCB. The reduction in shut height made possible by the present invention thus also makes possible a corresponding reduction in spacer size, and the attendant advantage of reduced misalignment thus accrues to any types of connectors having contacts force-fit in a board.

BRIEF DESCRIPTION OF THE DRAWINGS

FIG. 6 is an end cross section of a connector as the tooling descends to insert the contact pins therefrom a PCB.

FIG. 7 is an end cross section of the connector after insertion as the tooling is raised.

DETAILED DESCRIPTION OF THE PREFERRED EMBODIMENT

Figure 1:
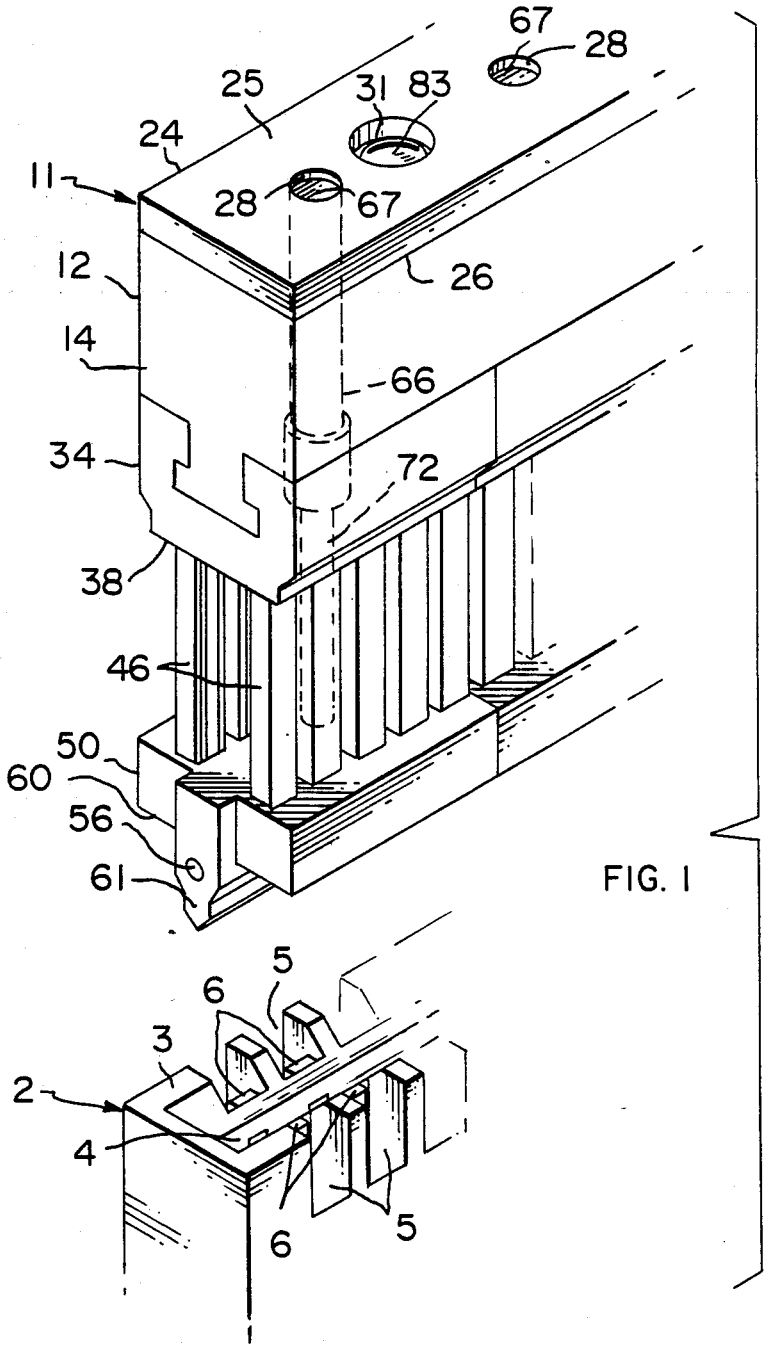
FIG. 1 is a perspective of the tool.

FIG. 1 is a perspective of the insertion tool 11, which comprises a body 12, insertion fingers 46 depending therefrom, and a guide block 50 slidably mounted on the fingers 46. Upper and lower telescoping tubes 66, 72 respectively are mounted in a bore through the body 12, the lower tube extending from bottom surface 38 and being fixed to guide block 50. The body 12 comprises a center portion 14, a steel top plate 24 fixed thereto by screws 83, and a bottom portion 34 keyed to the center portion 14. The guide 50 has a spine 61 on the bottom surface 60 thereof which is aligned with the card slot 4 in a connector 2 therebelow. The connector 2 comprises a housing 3 having contacts 6 nested in apertures 5, which contacts are borne on by insertion fingers 46 as will be described.

Figure 2:
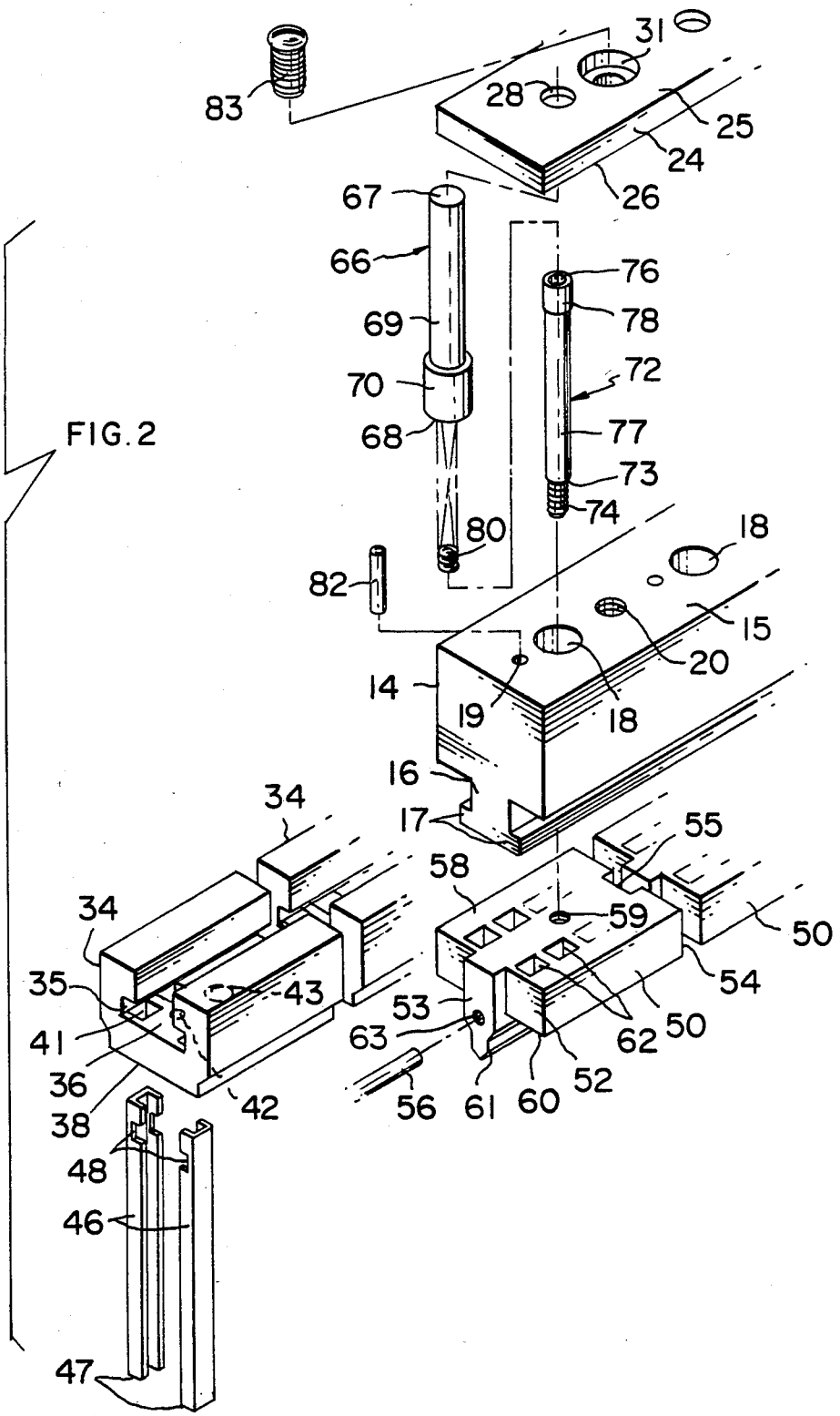
FIG. 2 is an exploded perspective of the tool.

FIG. 2 is an exploded perspective of the tool. Center portion 15 is an elongate member having a flat top surface 15 and an opposed T-section 16 with lateral flanges 17. Slide bores 18 and pin bores 19 extend through the center portion 14 from the surface 15, and tapped bores 20 extend into surface 15. The bottom portion 34 comes in sections as shown, each section having a T-shaped channel 35 having a floor 36. Two rows of rectangular apertures 41 extend through the portion 34 from the floor 36 to an opposed bottom surface 38, each aperture 41 being contiguous with a recess in a lateral wall in the T-channel 35. Pin bores 42 and slide bores 43 likewise extend through portion 34 from floor 36 to bottom surface 38. The insertion fingers 46 are channel like, having a notch 48 toward one end, and an opposed distal end 47. The guide block 50 likewise comes in sections, each section having a male end wall 52 with a key 53 and an opposed female end wall 54 with a channel 55. Rectangular apertures 62 in two rows extend from a top surface 58 to an opposed bottom surface 60 having a central spine 61. The shaft means comprises brass tubes 66, 72 which fit together telescopically over a coil spring 80. The upper tube 66 has a closed outer end 67, an open inner end 68, and an outer cylindrical surface 69 having a cylindrical flange 70 toward the inner end 68. The lower tube 72 has an open inner end 76, a closed outer end 73, and an outer cylindrical surface 77 having a flange 78 toward inner end 76. A threaded stud 74 extends from end 73. Top plate 24 has a top surface 25 which defines the top surface of the body 12 when assembled and an opposed bottom surface 26. Slide bores 28 and countersunk screw holes 31 extend therethrough.

Assembly will be readily understood with reference to FIG. 2. The fingers 46 are inserted in apertures 41, and the sections of bottom portion 34 are keyed to center portion 14 and held fast by spring pins 82 inserted into bores 19 and passing into bores 42 (FIG. 5A). The notches 48 fit on flanges 17 to hold the fingers 46. The lower tubes 72 are dropped through respective bores 18 and 43 and screwed into holes 59 in the guide block 50, sections of which are held together by a single rod 56 press fit through the bore 63. A spring 80 is then fit into each lower tube 72 and an upper tube 66 is fit into each bore 18 over flange 78 of a lower tube 72. The top plate 24 is then screwed to center portion 24 with the surface 69 of tube 66 fitting smoothly through a bore 28.

Figure 3:
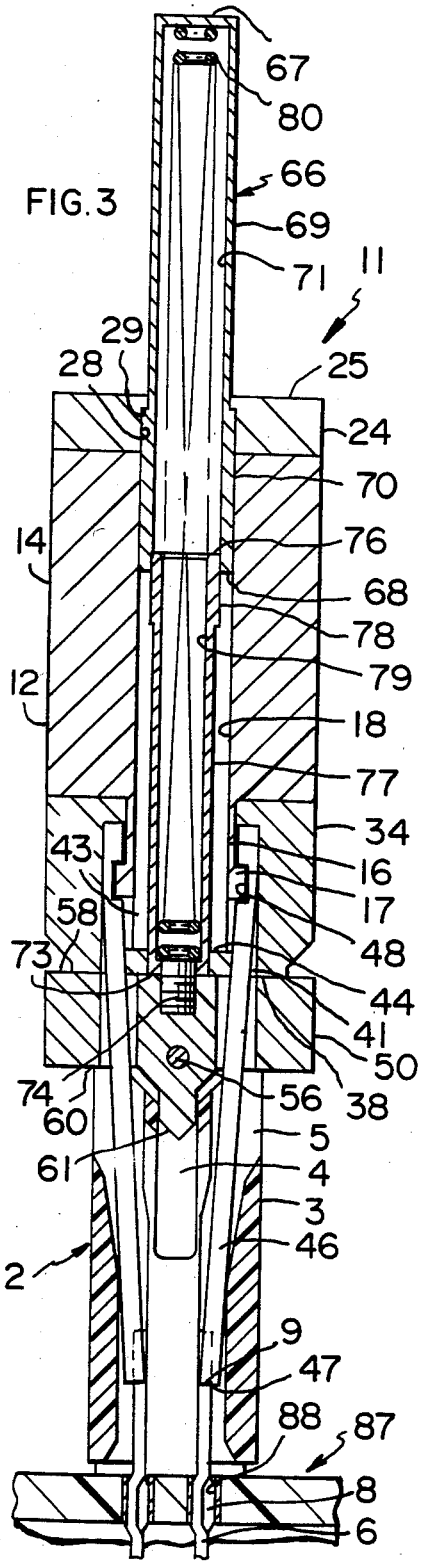
FIG. 3 is an end cross section of the tool on a premounted connector prior to press descent.

FIG. 3 is an end cross section of the tool 11 sitting on a connector 2 premounted to a circuit board 87, which serves as a tool support on a dummy workpiece. The function of the premounted connector or dummy workpiece is described more fully in the companion U.S. application Ser. No. 618,983. It is at this stage that the relatively short height of body 12 and corresponding low center of gravity are of advantage in preventing too much lean of the tool 11. The bottom surface 60 of guide block 50 rests on connector 2 with spline 61 centered in card slot 4. The top surface 58 is flush against bottom surface 38 of body 12, and the spring 80 is in an unloaded condition, causing outer end 67 of upper tube 66 to extend considerably above top surface 25. The flange 70 fits smoothly in bores 18, 28; upward travel is limited by shoulder 29 in bore 28. The flange 78 fits smoothly in bore 71 in upper tube 66 while outer surface 77 fits smoothly in bore 43 through bottom portion 34, where shoulder 44 limits downward travel of flange 78, as will be shown. The distal ends 47 of insertion fingers 46 rest on shoulders 9, while the notches 48 are keyed on flanges 17 of the T-section 16.

Figure 4:
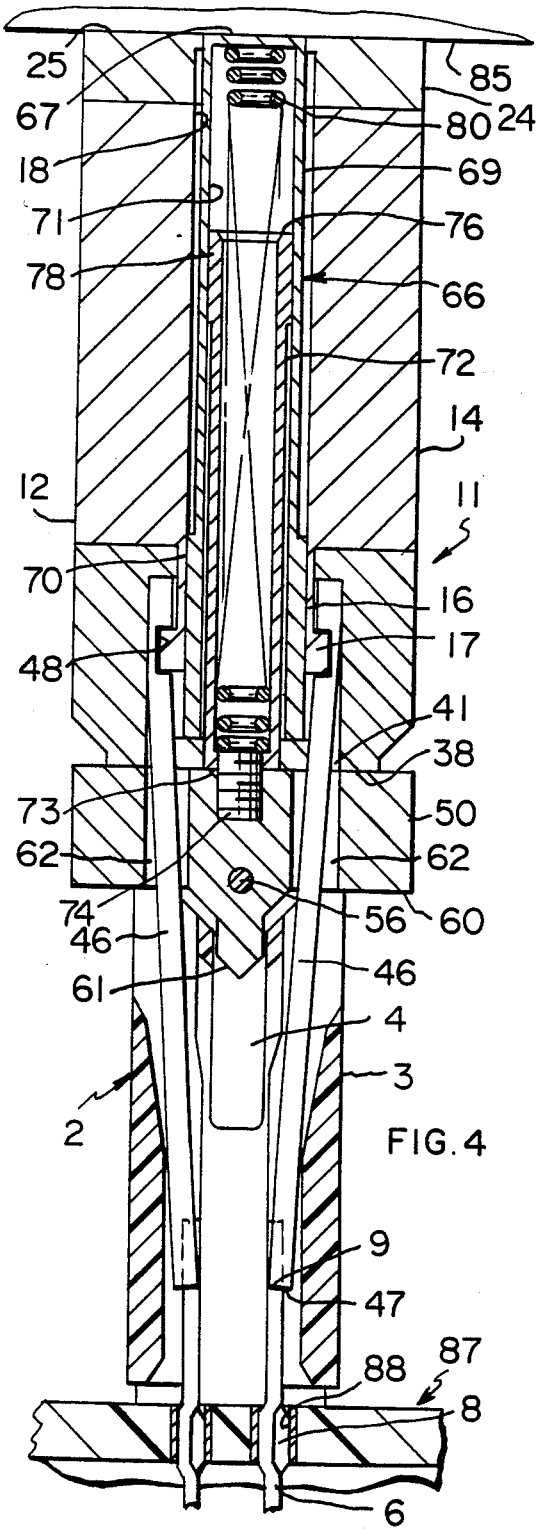
FIG. 4 is an end cross section of the tool on a premounted connector with the press fully descended.

FIG. 4 depicts the tool 11 with distal end 67 of upper tube 66 lying flushly with top surface 25, as effected by the descent of press 85. This causes the spring 80 to be fully compressed as the flange 70 rides downward in bore 18 and the lower tube 72 telescopes into bore 71 of upper tube 66. At this point the electromagnet in press 85, also referred to elsewhere herein as the magnetic chuck, is activated to strongly attract the top plate 24.

Figure 5:
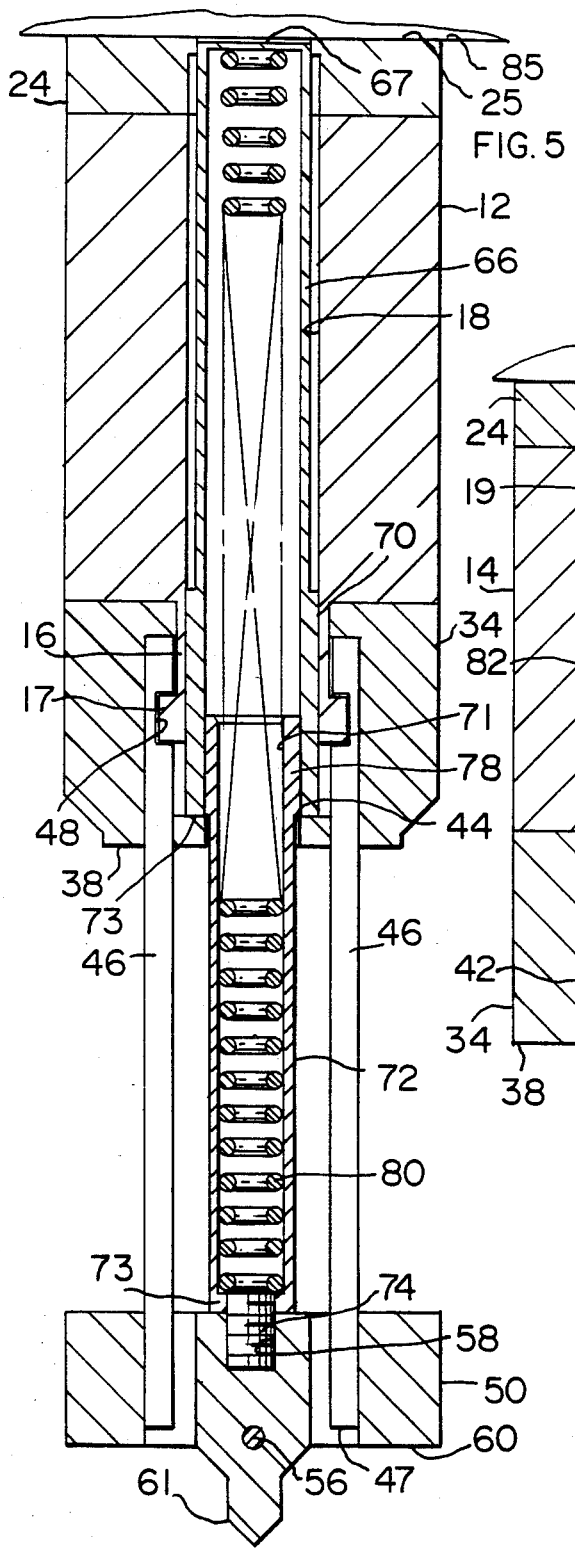
FIG. 5 is an end cross section of the tool fixed to the magnetic chuck when raised.
Figure 5A:
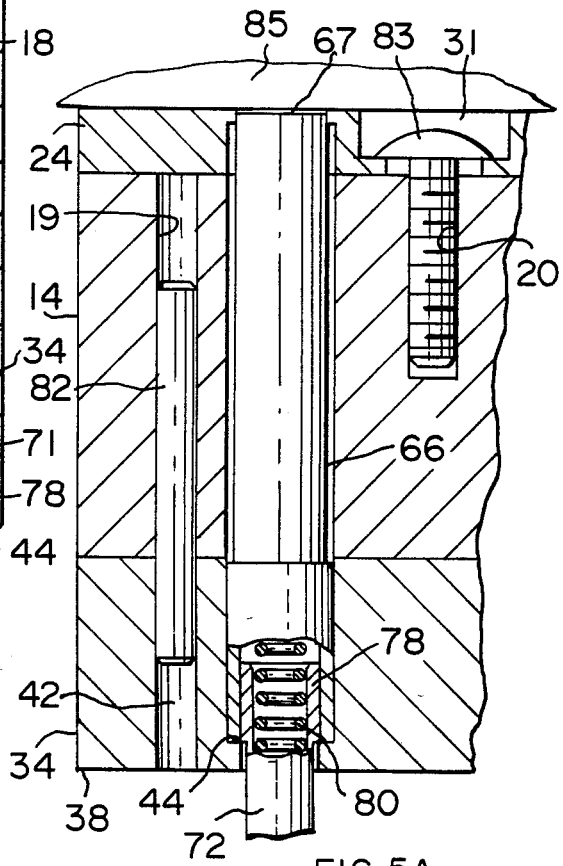
FIG. 5A is an end cross section of the tool fixed to the magnetic chuck when raised.

FIG. 5 shows the tool 11 with outer end 73 of lower tube 72 fully extended from bottom surface 38 as the spring 80 expands to urge the guide block 50 away from bottom surface 38. Downward travel of block 50 is limited as flange 78 bears on shoulder 44. The tool 11 is held to press 85 by magnetism; the tool 11 is thus positioned to insert a connector 2 positioned as the tool support shown as a connector 2 is previous FIGS. 3 and 4.

FIG. 6 depicts the descent of tool 11 toward such a connector 2; note that pins 7 are loosely fit in plated through holes 88 of board 87 and extend into platen 89. The retaining sections 8 are as described in U.S. Pat. No. 4,186,892 and must be force fit into the holes 88. Any angular misalignment of connector 2 is corrected as spine 61 enters card receiving slot 4 during the down stroke. The bottom surface 60 will bear against the connector 2 as insertion fingers 46 pass through apertures 63 into apertures 5 until the distal ends 47 meet shoulders 9 of contacts 6. The housing 4 and contacts 6 then move downward together as the retaining sections 8 are force fit into holes 88 to yield the configuration depicted in FIG. 4. The distance between the distal ends 47 and the bottom 60 when the guide block 50 is against tool body 12 must be closely controlled so that the contacts 6 are not displaced relative to housing 4.

FIG. 7 shows the retreat of tool 11 after the retaining sections 8 are fully inserted. Deformable legs 10 on the bottom of connector 2 are somewhat flattened to compensate for variations in thickness of board 87. This feature assures a positive positioning of the contacts 6 relative to the housing 3 for a fixed press stroke regardless variations in thickness of the PCB 87.

We claim:

1. A connector insertion tool for mounting to a press and mass inserting a plurality of contact pins depending from a connector into a printed circuit board, said tool being of the type comprising a body having a top surface and an opposed bottom surface, two rows of insertion fingers extending from said bottom surface, guide means slidably mounted on said fingers, shaft means fixed to said guide means and slidably received in bore means in said body, and spring means being effective to urge said guide means away from said body when said body is mounted to said press, characterized in that, said tool is adapted for magnetic mounting of said top surface to said press, said shaft means comprising telescoping tube means slidably mounted in said bore means in said body and extendable from either surface thereof, said spring means comprising a coil spring mounted inside each said telescoping tube means, said tube means being collapsed to load said spring in compression when said body is mounted to said press and said guide means is moved toward said bottom surface during insertion of said contacts, said spring being effective to extend said tube means from said bottom surface to move said guide means away from said bottom surface when said body is mounted to said press during withdrawal of said tool after insertion, said spring being effective to extend said tube means from said top surface when said body is not mounted to said press and said guide means is moved toward said bottom surface.

2. A connector insertion tool as in claim 1 characterized in that said telescoping tube means comprises a lower tube having a closed outer end extendable beyond said bottom surface and an open inner end in said body, and an upper tube having a closed outer end extendable beyond said top surface and an open inner end in said body, said inner end being telescopically matable with said inner end of said lower tube.

3. A connector insertion tool as in claim 2 wherein each tube has flange means toward the inner end thereof on the outside surface of the tube, said bore means having shoulder means toward both top and bottom surface, said shoulder means being cooperable with said flange means to retain said inner ends in said bore means.

* * * * *